US006223682B1

(12) United States Patent
Venier

(10) Patent No.: US 6,223,682 B1
(45) Date of Patent: May 1, 2001

(54) LOCATING DEVICE FOR AVALANCHE VICTIMS

(76) Inventor: Daniela Venier, Gaissau 55a, A-5421, Krispl (AT)

( * ) Notice: Subject to any disclaimer, the term of this patent is extended or adjusted under 35 U.S.C. 154(b) by 0 days.

(21) Appl. No.: 09/205,609

(22) Filed: Dec. 4, 1998

(30) Foreign Application Priority Data

Jun. 10, 1998 (AT) ..... 391/98 U

(51) Int. Cl.[7] ..... G08B 5/02
(52) U.S. Cl. ..... 116/209; 116/200
(58) Field of Search ..... 116/209, 200; 446/476, 478; 135/132, 133, 135, 136

(56) References Cited

U.S. PATENT DOCUMENTS

| | | | | |
|---|---|---|---|---|
| 2,023,813 | * | 12/1935 | Jolly | 135/132 |
| 3,161,231 | * | 12/1964 | Dawson et al. | 135/133 |
| 5,199,375 | * | 4/1993 | Johson | 116/209 |
| 5,467,730 | * | 11/1995 | Kovaletz | 116/209 |
| 5,842,495 | * | 12/1998 | Egnew et al. | 135/133 |

FOREIGN PATENT DOCUMENTS

| | | |
|---|---|---|
| 2444712 | 4/1976 | (DE) . |
| 2558303 | 7/1977 | (DE) . |
| 2326850 | 10/1977 | (DE) . |
| 3300841 | 7/1984 | (DE) . |
| 296 09 433 U | 10/1996 | (DE) . |
| 19516872 | 11/1996 | (DE) . |
| 297 09 269 U | 10/1997 | (DE) . |
| 2644700 | 9/1990 | (FR) . |

* cited by examiner

*Primary Examiner*—Andrew H. Hirshfeld
(74) *Attorney, Agent, or Firm*—Rothwell, Figg, Ernst & Manbeck

(57) ABSTRACT

A locating device for avalanche victims having a collapsible, balloon-like envelope having a release and drive means to expand said envelope, and having a connecting element to connect said locating device with the user is provided with at least two essentially rigid opening parts (3, 3', 11), which are connected to said envelope (7), being movable relatively towards each other by spring power and are being held in their resting positions by means of a releasable locking means (5).

22 Claims, 7 Drawing Sheets

LOCATING DEVICE FOR AVALANCHE VICTIMS

BACKGROUND OF THE INVENTION

The present invention relates to a locating device for avalanche victims comprising a collapsible, balloon-like envelope having a release and drive means to expand said envelope and a connecting element to connect said locating device with the user.

Furthermore, the invention relates to an ejector means for such locating device.

The invention also relates to a pouch to stow such folded locating device.

In order to save the lives of avalanche victims, it is essential to locate and rescue them quickly. Persons entirely buried in an avalanche have a 92% chance of survival if they are rescued within 15 minutes, which means that the help of their companions is the most important measure to save their lives. In order to find and rescue them, it is essential that they are immediately located. Therefore, various ways to locate avalanche victims have been proposed:

In practice, an electronic avalanche victim detector using sending and searching frequencies is often used to locate avalanche victims (see. e.g., FR-A 26 44 700). This detector, however, has proven successful only if its use is practiced repeatedly, which means that in reality the rescue operation using said electronic detector will not proceed smoothly and will often be too late.

PRIOR ART

DE-U 296 09 433 discloses a detector for avalanche victims having an inflatable buoy in luminous color and an integrated alarm device for easier visual location of the victim. The buoy is connected to a system mounting plate via a coupling cylinder, which plate is attached to a rucksack. When manipulating a release cord, the buoy is released by means of a pressure spring and rises after it has been filled with air. The position of the victim can be found by means of a rope connecting the buoy to the victim. The system of inflating the buoy, however, suffers from a number of disadvantages. Inflation by the skier in case of an imminent avalanche would take too long. Therefore, an additional valve with some kind of air pump would be necessary to inflate the buoy quickly enough.

DE-B 23 26 850 and DE-A 195 16 872 describe locating devices in the form of a balloon inflatable with compressed gas, which balloon will indicate the position of the person swept away in an avalanche on the surface of said avalanche. Such a locating device, however, requires that a compressed gas bottle be attached to the balloon, which increases the weight of the locating device and makes it uncomfortable to carry while skiing. Another disadvantage is that, once inflated, the balloon can usually not be re-used. Inflating it again would require an exchangeable compressed gas bottle, and some spare compressed gas bottles would have to be kept, which is quite costly and complicated. It would be particularly disastrous if the balloon were inflated accidentally due to a wrong signal during a skiing tour, as then said ballon could not be inflated any more in case of a real emergency because the compressed gas bottle would be empty.

DE-A 5 58 303 also describes a device having an inflatable element and a gas generator to generate the filling gas. This embodiment can be re-used several times, but its construction is complicated and costly; besides, said device is necessarily heavy and thus uncomfortable to carry.

DE-A 33 00 841 discloses a device for self-protection in case of an avalanche comprising a container holding a compressed element of foamed material or similar. This expandable element can be released from said container by means of a trigger and will expand to a spherical shape many times its original volume. This construction is complicated, too, and, as above, said device is for a single use only.

SUMMARY OF THE INVENTION

Therefore, it is the aim of the present invention to provide a locating device as described above allowing ready location of avalanche victims, which locating device should be easy to manufacture, function simply, have only minimal weight and be easily re-foldable after use and thus be re-usable.

The locating device according to the present invention as described above is characterized in that at least two essentially rigid opening parts, which are connected to the envelope, are movable relatively towards each other by spring power and are being held in their resting positions by means of a releasable locking means. In this embodiment, at least one spring can be easily inserted into the locating device without extensive technical effort, with the rigid opening parts being kept under tension by means of said spring in the resting position, i.e. folded, and being kept in this position by means of a releasable locking means. If necessary, the release means is activated and thus the locking means is released, whereupon said opening parts are moved relatively towards each other by spring power, resulting in the folded detection device expanding, i.e. opening, e.g. assuming the shape of a balloon. Said envelope is connected to said opening parts, and when expanded, it will define a relatively large volume filled with air. Being light-weight, the expanded locating device will be carried on the uppermost layer of an avalanche without being buried in the snow. Thus said locating device, the envelope of which is e.g. made of flashy-coloured material, will remain readily visible from afar after the avalanche has come down. A connecting element, preferably a line, a rope, or a cord, will lead from the locating device through the snow to the victim.

It is another advantage of the present invention that the expansion of said envelope to a balloon-shaped rescuing device is effected solely by spring power, which not only ensures ready and very fast, immediate expansion within fractions of a second, but also allows the device to be small and light-weight. Moreover, the locating device according to the present invention can be easily re-folded after expansion and is thus ready to be re-used within a very short time. Thus it can be used repeatedly practically any number of times without consuming material; and moreover, it is not necessary to carry any additional parts, such as a (spare) compressed gas bottle. Spring tension can be increased, if necessary, or relaxed in order to save the spring if the device is to be stored, optionally going as far as to utterly relax the spring.

Preferably two opening parts under the action of a spring are provided to define an expanded, balloon-like volume. In this case, the opening parts are relatively rigid and are moved relatively towards each other by spring power. The term "ballon-like" as used herein denotes spherical round as well as other, e.g. flatter or pumpkin-like shapes. When folded, the opening parts and the envelope together have a flat shape.

The volume filled with air within the envelope may be defined to be of various sizes. Is was found, however, that the optimum volume ranges between 30 and 60 l, preferably 45 l. Of course it is also conceivable to provide a locating device having e.g. a larger volume.

In an advantageous embodiment the opening parts are bows or plates of e.g. essentially semicircular, semi-oval or U-shape, respectively, pivoted rotatably around an axis. When the envelope is folded, the bows or plates are positioned side-by-side. By means of the release means, the bows or plates are set in a relatively rotating motion of a total of about 360° around said axis so that the flat, somewhat U-shaped construction takes on the shape of a balloon.

Of course the plates or bows can also be of polygonal shape. The optimum shape for the largest possible volume with a given axis is achieved by semicircular bows; when expanded, the locating device will be of about spherical shape.

For a compact design of the locating device-it is desirable that the axis be defined by at least one torsion spring holding the bows or plates under tension relatively to each other. Other types of springs may be contemplated as well, but optimum use of space is achieved by said at least one torsion spring positioned on the rotation axis of the locating device. The ends of the bows or plates are attached to the two ends of said at least one torsion spring under tension, and they are kept together by means of a releasable locking means when the device is folded. After said locking means has been released, said bows or plates move very quickly in opposing directions around the rotation axis until they come together again, e.g. after a rotation of 180° each.

Said locking means can be formed in a known manner. For example, a hook may be mounted on one opening part, which hook overlaps the other opening part(s). It is also possible that two rings, each of which is mounted on one opening part, are held together by means of a rod or similar. The only important point is that the locking means can be safely released by means of the release means resulting in the opening parts being spread apart by spring power.

In another desirable embodiment, two torsion springs in axial alignment are provided, each of which acting on one of the bows or plates. Thus the action of said torsion spring is not concentrated on but one point of each opening part, as in the embodiment having only one torsion spring, but rather said spring will exert pressure symmetrically on two points each, i.e. on both ends of the two bows or plates adjacent to the ends of the axis. Thus said bows or plates do not jam so easily and may be thinner in shape. This helps reduce the weight of the locating device and the size of the opening parts. Another advantage is that if one spring should fail, the other spring will still ensure proper functioning of the device.

Another advantageous embodiment is characterized in that, when expanded, the bows or plates are held together by a locking means, e.g. a magnetic lock or a velcro. After the bows or plates have rotated by a total of 360°, they should maintain their positions, forming a balloon-like object filled with air. While the avalanche is coming down, however, various forces will act upon the locating device, resulting in the danger of the envelope opening again as the bows or plates are being forced apart. Thus snow could get inside the envelope, making it much heavier and unfit to realize its purpose. Therefore, a locking means is used to keep the bows or plates in their desired positions, which locking means may also be a snap-in lock apart from a magnetic lock or a velcro.

For the defined volume of the expanded locating device to be as big as possible, it is advantageous that several, e.g. four to eight, intermediate bows or plates connected to the envelope be pivoted rotatably aroud the axis between two bows or plates. In this embodiment, said bows or plates are kept under tension against each other by means of at least one torsion spring, while said intermediate bows or plates are only mounted on said spring axis and connected to said envelope without being under direct spring pressure. When said bows or plates rotate by a total of 360°, said intermediate bows or plates will be pulled along by said envelope. Thus said envelope is opened like a balloon around said rotation axis.

In order to make said locating device as light-weight as possible, it is advantageous that the opening parts be made of aluminium or plastic, preferably nylon, polyethylene, or glass fiber plastic.

In a desirable embodiment the opening parts are connected to the envelope by means of loops or velcros, or said parts are sewn or welded into said envelope. Velcros allow ready and easy removal of the envelope, either in order to repair the locating device or in order to relax the spring for longer storage: The envelope is removed from the opening parts, which-in the case of rotatable bows-can now be rotated around the axis to relax. In this case, e.g. one bow is slightly smaller than the others so that it can be rotated as many times around the torsion spring under the other bows until finally the spring has the desired tension. After this operation, the spring may be under stronger or lighter tension or under no tension at all, e.g. for storage. If the opening parts are connected to the envelope via opening loops, said opening parts can also be removed from the envelope.

If said opening parts are sewn or welded into said envelope, the locating device can not be dismantled so easily, but on the other hand said opening parts are so firmly fastened to said envelope that they will not come off accidentally.

For maximum stability of the locating device, it is also advantageous that an essentially rigid axis be located within said torsion spring(s). Said axis may preferably be made of light material, e.g. plastic or aluminium. In this embodiment, said at least one torsion spring is mounted like a coat around said rigid axis, so that it does not become bent when in use. This considerably increases the stability of said locating device without requiring additional space.

Preferably all opening parts are located on the rigid axis. Thus the reaction force of said opening parts will not act on said torsion spring but rather on said more stable rigid axis.

In order to keep the device small, at least some of said bows or plates, optionally intermediate bows, are conveniently mounted on at least one intermediate segment which, in turn, is mounted on said torsion spring or rigid axis, respectively. Thus, not all plates or bows are mounted on said spring or rigid axis, respectively. If they were, they would require quite some space there and would make said spring or rigid axis, respectively, longer than actually necessary. A construction, on the other hand, wherein several, e.g. two to four, plates or bows are mounted on said at least one intermediate segment, which in turn is mounted on said spring or rigid axis, respectively, will require less space. It may also be contemplated that several intermediate segments be located one behind the other like cascades, with several plates or bows being mounted on one intermediate segment which, in turn, is mounted on another intermediate segment together with other intermediate segments. Said intermediate segments are preferably made of light, stable material, such as sheet metal.

In another space-saving embodiment, at least one bow or plate, optionally intermediate bow, is (are) connected only to the envelope. Thus said bows or plates are not fastened to the spring or axis, respectively, and therefore said spring or axis, respectively, need not be longer than absolutely necessary.

In order to nevertheless ensure sufficient stability of the locating device said envelope may be additionally reinforced, e.g. by doubling in the appropriate places, i.e. where no bows or plates are located.

Moreover, it is of advantage to cover at least one opening part with a net. Preferably both bows or plates are covered by a net reaching as far as the rotation axis. This keeps snow from getting inside the locating device filled with air when said device expands as an avalanche comes down.

Advantageously a pull cord is attached to the locking means in order to release it. In a dangerous situation, said locking means can be released simply by pulling said cord (causing, e.g., a rod to be pulled out of two rings). If the locating device is carried on the user's back, said pull cord preferably hangs over the user's shoulder and is kept in an easy-to-reach position e.g. by means of a velcro. In another conceivable embodiment, the locking means is released by means of a push button located in an easy-to-reach position. For instance, manipulating said push button can cause a hook used as a locking means to move.

It is particularly useful to fasten a connecting element via two connecting means to the region of the two outer ends of said torsion spring(s). As the locating device, when expanded, is under quite some tension and pressure, this embodiment gives additional security in the sense that said connecting element will remain connected to the locating device. Said connecting means may be fastened to said locating device in any conventional manner, e.g. using rings, loops or eyelets, or by sewing them to the envelope; said connecting element may also be pulled through the-hollow-rigid axis or the at least one torsion spring, respectively.

If said connecting element has at least one flexible section, it is particularly safe. Said flexible connecting element is supposed to allow the balloon to escape any second avalanche. It would be possible to have said at least one flexible section both instead of and in addition to the original connecting element(s).

In another advantageous embodiment, an additional piece of cloth is attached to said connecting element for buoyancy of the locating device like a parachute or kite. Said additional piece of cloth will lift said locating device upwards, making sure that said locating device will stay above the snow. Particularly when the risk of an avalanche is very high, as a precaution said locating device could be expanded even before skiing downhill and would hover in the air behind the skier like a kite or parachute.

It is particularly useful to give the cross section of said locating device the shape of the cross section of an airfoil to achieve buoyancy. The desired cross section is determined by the shape of the opening parts. If the locating device is pulled behind by the user, relative wind will blow against the locating device causing some suction on the upper side of the locating device functioning like an airfoil, which suction action will cause said locating device to be buoyed upwards.

It is also of advantage to stow the locating device folded in a pouch having at least two pouch parts detachable from each other after releasing the locking means of said opening parts or a pouch seal, respectively, for expanding the locating device. Said pouch is designed such that it will open immediately when said locating device expands without impeding said expansion in any way. Said pouch may e.g. be sealed my means of velcros opening in the opposite direction to the locating device.

Preferably at least the two opening parts are engaging. While the locating device expands, said opening parts may thus be moved in one direction by spring power and will engage and thus remain in their respective positions. If, due to snow, branches, etc., the locating device can not expand completely, it will remain at least partly expanded, thus still allowing detection of the victim.

In a preferred embodiment, the bows for engaging have at least two toothed washers, with the sides of said toothed washers facing each other, gliding in the direction of expansion and blocking in the opposite direction. Each of said two bows preferably has one toothed washer with a toothed side, with said toothed sides of said two toothed washers facing each other. The toothing may e.g. be inclined teeth or ribs extending radially outward from the center of the washer. By the action of the spring, said washers are pressed together, and the orientation of said teeth allows rotation in the direction of expansion. As the teeth engage, the bows can not rotate in the opposite direction. The locating device expands by the bows and thus the washers being pulled apart so that said teeth are set free. Preferably it is only possible to pull said bows apart by pushing away one bow. This makes sure that the bows can not be pulled apart by the action of some outside force, e.g. branches or masses of snow.

For ready and successful location the locating device may additionally have an acoustic alarm device within or on the envelope, as already known in the art, which may e.g. be activated by a release means. This makes sure that the avalanche victim will even be found under poor visibility conditions.

The ejector means according to the invention for the present locating device is characterized in that said locating device can be thrown away from the user in order to expand after triggering a spring kept under tension in a guide rail. For example, a coil spring is fixed under tension, pressing on the one side against a holding device and on the other side against the folded locating device via a connecting means. By manipulating a release means, said spring will spring apart and thus push said locating device away from said holding device, i.e. away from the user. Said spring moves along said guide rail for optimum control of direction, which guide rail is e.g. made of plastic or aluminium. The ejector means makes sure that in the snow said locating device will not move away from the user horizontally or downwards but will rather be thrown upwards into the air.

The pouch according to the present invention to stow the folded locating device is characterized by at least two pouch parts detachable from each other when said locating device expands by releasing the locking means of the opening parts or a pouch seal, respectively. The pouch, which is preferably U-shaped, may e.g. be sealed by means of a velcro which allows particularly easy opening.

BRIEF DESCRIPTION OF THE DRAWINGS

The present invention will be illustrated in greater detail below by means of preferred embodiments depicted in the drawings, which, however, are not to be construed as limitations. In the drawings.

DETAILED DESCRIPTION OF THE PREFERRED EMBODIMENTS

Figure 1:
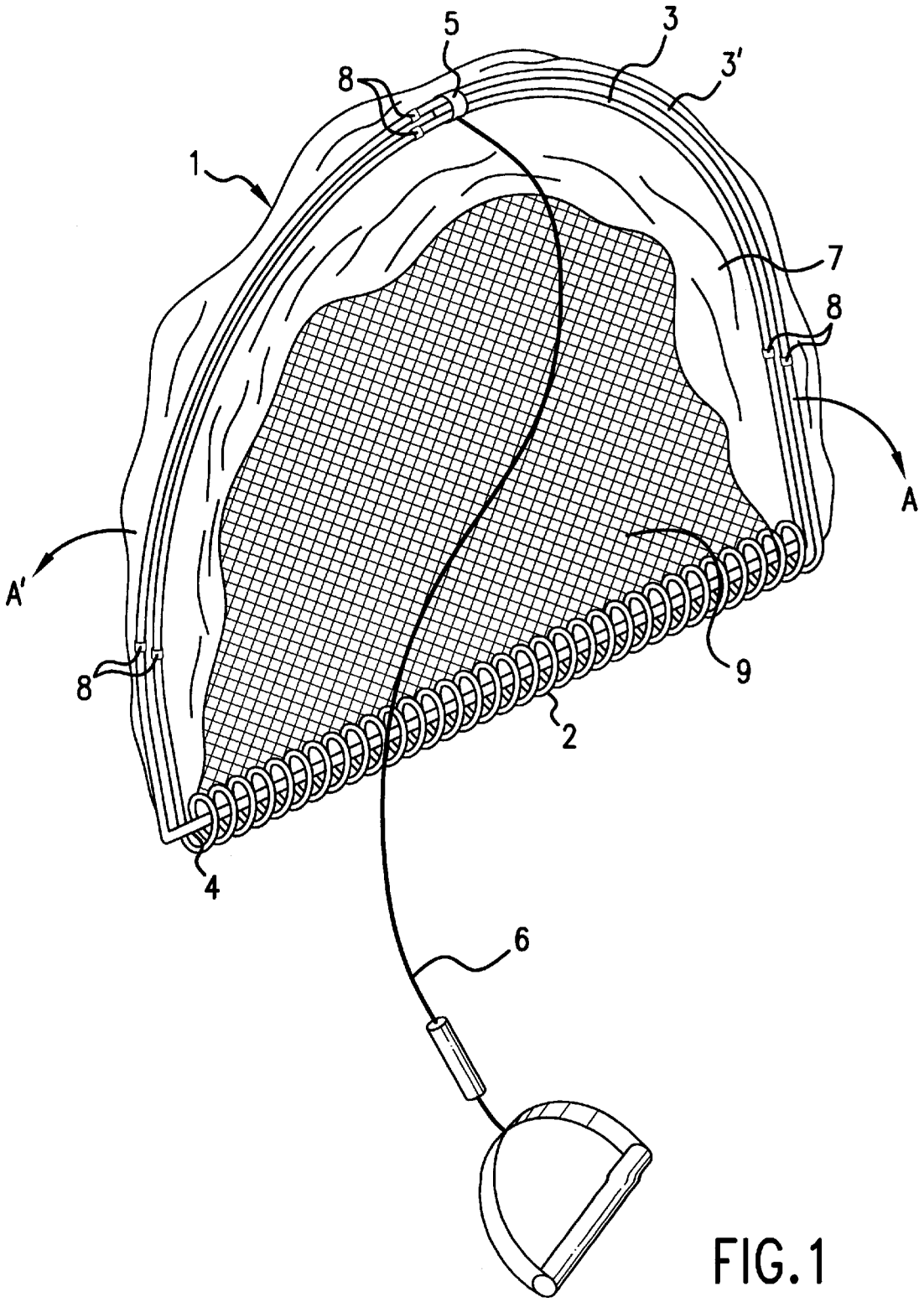
FIG. 1 shows a folded locating device having one torsion spring.

FIG. 1 shows a folded locating device 1 with a torsion spring 2 exercising a spin tension on two opening parts having the shape of bows 3, 3'. A rigid axis 4 is located within the torsion spring 2 to stabilize the locating device 1. The bows 3, 3' are held together by a releasable locking means 5, schematically represented herein as a velcro. The velcro is opened by manipulating a pull cord 6, and the bows 3, 3' are pushed in the direction of the arrows A, A' by the torsion spring 2. An envelope 7 in loud color(s) hangs loosely on the bows 3, 3' when folded as shown; the envelope is connected to the bows via schematically represented loops 8. FIG. 1 shows no intermediate bows, because they are hidden between the two bows 3, 3' by the envelope 7. The bows 3, 3' each have a net cover 9, which keeps any objects, such as snow, from getting into the locating device 1 while it expands. Instead of said bows 3, 3' with the net cover 9, the opening parts may also be integrally formed as plates.

Figure 2:
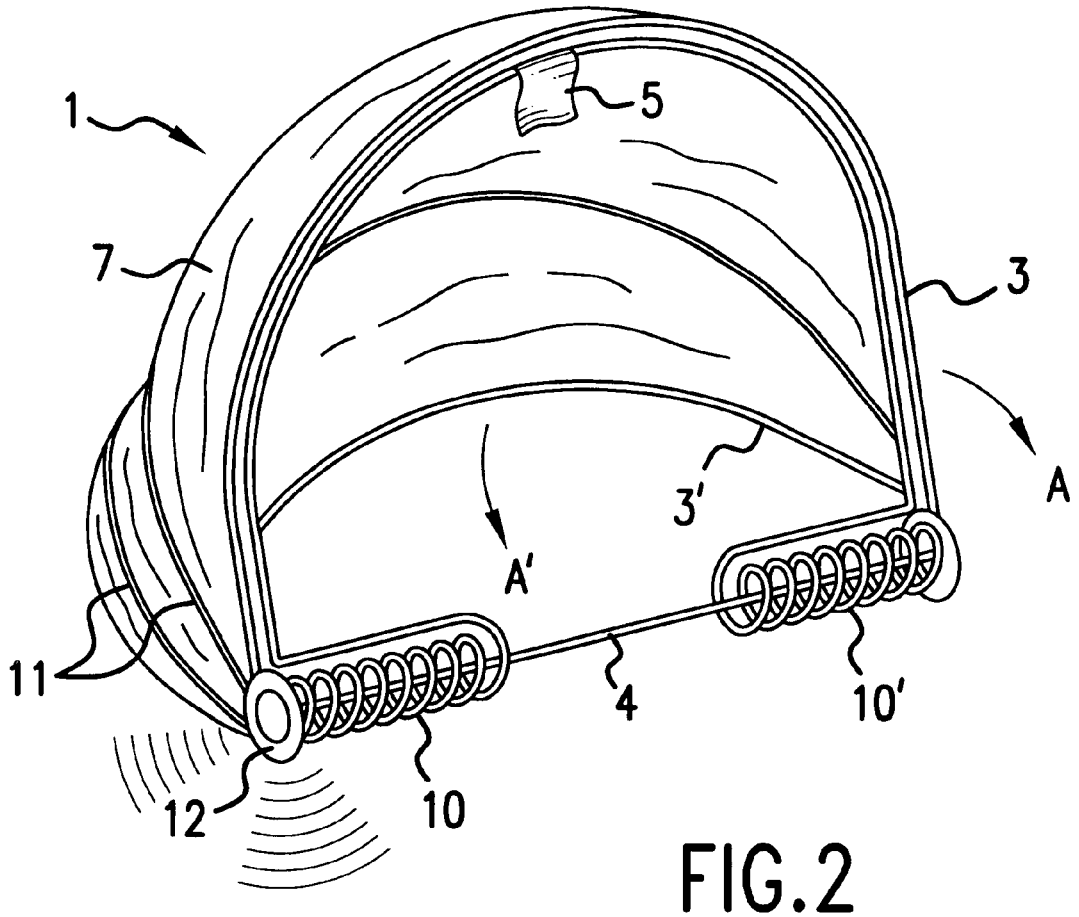
FIG. 2 shows a locating device having two torsion springs during expansion.

FIG. 2 shows a quite similar locating device 1 during expansion, with two bows 3, 3' functioning as opening parts (shown herein without a net) being moved relatively towards each other in the direction of the arrows A, A' by the power of the two torsion springs 10, 10'; the envelope 7, also connected to intermediate bows 11, is pulled along by the bows 3, 3'. Before that, the locking means 5 has been released; for the sake of simplicity, FIG. 2 does not show the pull cord nor a connecting element to connect the device with the user.

Moreover, according to FIG. 2 an acoustic alarm device 12 is attached to the locating device 1 as an additional help to locate the victim, particularly under poor visibility conditions.

Figure 3:
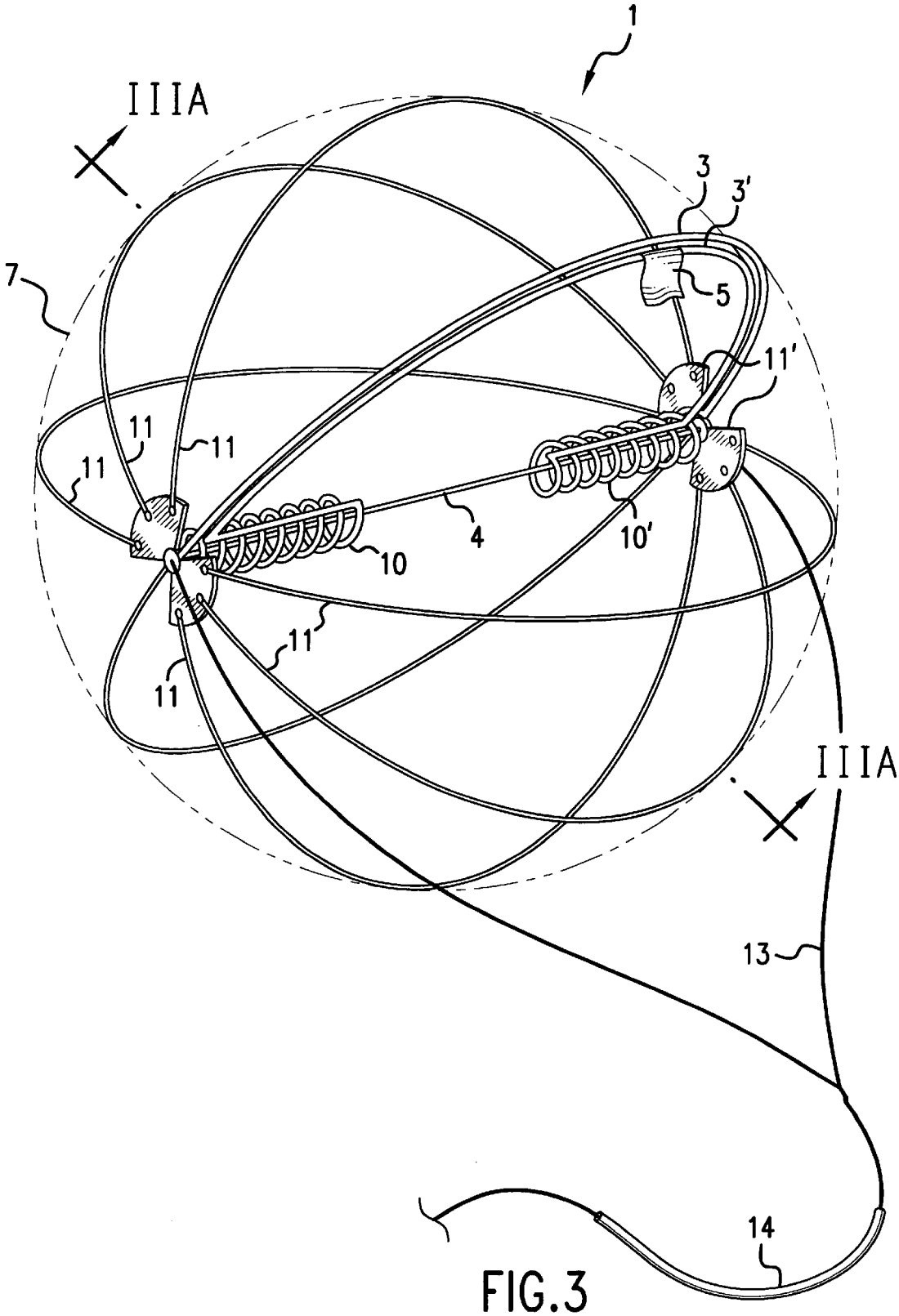
FIG. 3 shows an expanded locating device having two torsion springs.

FIG. 3 shows a locating device 1, e.g. that of FIG. 2, after it has expanded, i.e. opened, with the envelope 7, which now has taken on the shape of a balloon, only being represented schematically by a broken line. In this position the bows 3, 3' come together again and are held together by a magnetic lock 5', (see FIG. 3A) when the device is open. The balloon-like shape is defined around the rigid axis 4 by the bows 3, 3' and the intermediate bows 11. In this example, groups of three intermediate bows 11 each are attached to one intermediate segment 11' so that two intermediate segments 11' are located at each end of the rigid axis 4; this construction requires less space along the length of said rigid axis 4 to fasten the intermediate bows 11 on said rigid axis 4.

FIG. 3 also shows a connecting element 13 in the form of a rope or cord connecting the locating device 1 with the user (not shown). Said connecting element 13 is branched and attached to the two ends of the rigid axis 4 in the region of the two outer ends of the torsion springs 10, 10' via two connecting means; moreover, it has an elastic section 14 to keep said connecting element 13 from breaking off the locating device 1 in case of a second avalanche, because said elastic section can extend the length of the connecting element 13 if necessary.

Figure 3A:
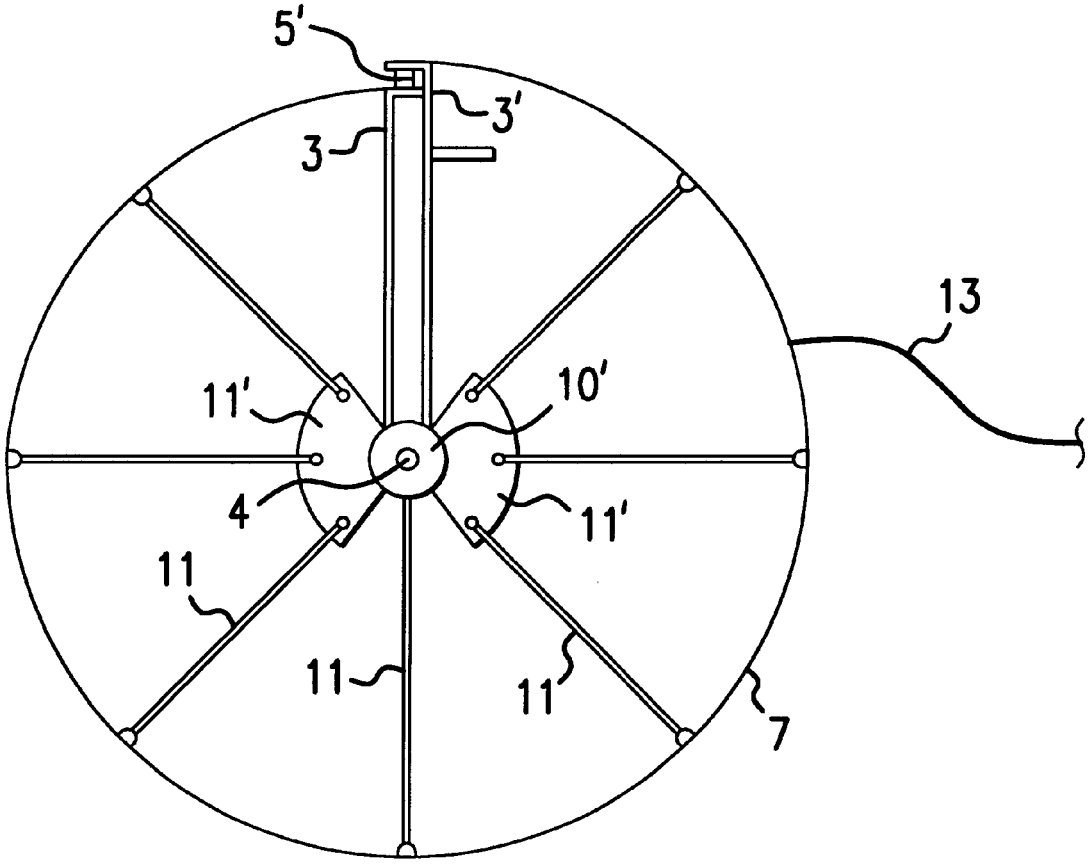
FIG. 3A is a schematic cross section of an expanded locating device along the line IIIA—IIIA in FIG. 3.

FIG. 3A shows a cross section of the expanded locating device 1. One magnetic lock 5' each is mounted on the smaller bow 3' and the larger bow 3, keeping them together when expanded. Moreover, the bow 3' has released locking means 5, shown herein as a velcro band. According to FIG. 3, groups of 3 intermediate bows 11 each are fixed on one intermediate segment 11', which in turn is pivoted rotatably on the rigid axis 4. The intermediate bows 11 are fastened to the envelope 7 by means of loops 8.

Figure 4:
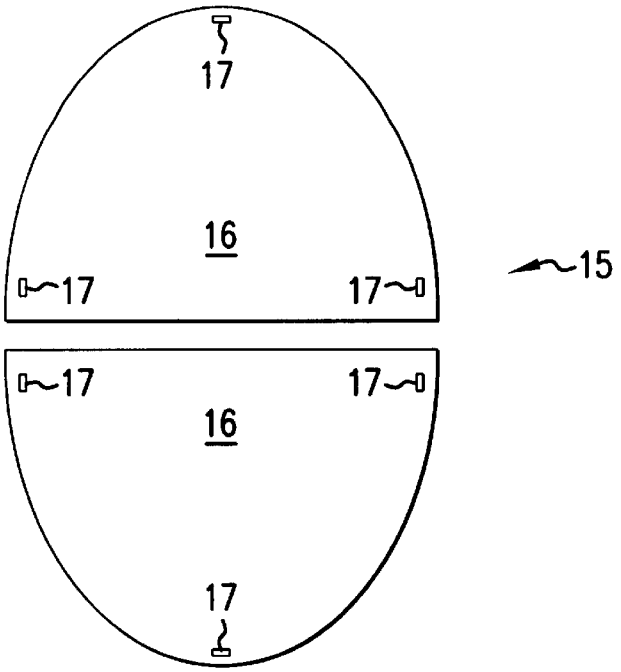
FIG. 4 is a schematic representation of a pouch to stow the folded locating device.

FIG. 4 shows an opened pouch 15 consisting of two separate, yet identical parts 16. When closed, said pouch 15 serves to protect the locating device 1 from external influences, e.g. humidity, dirt, etc. To close said pouch 15, velcro seals 17 are attached punctually along the edges, which seals open immediately when the locating device 1 expands.

Figure 5:
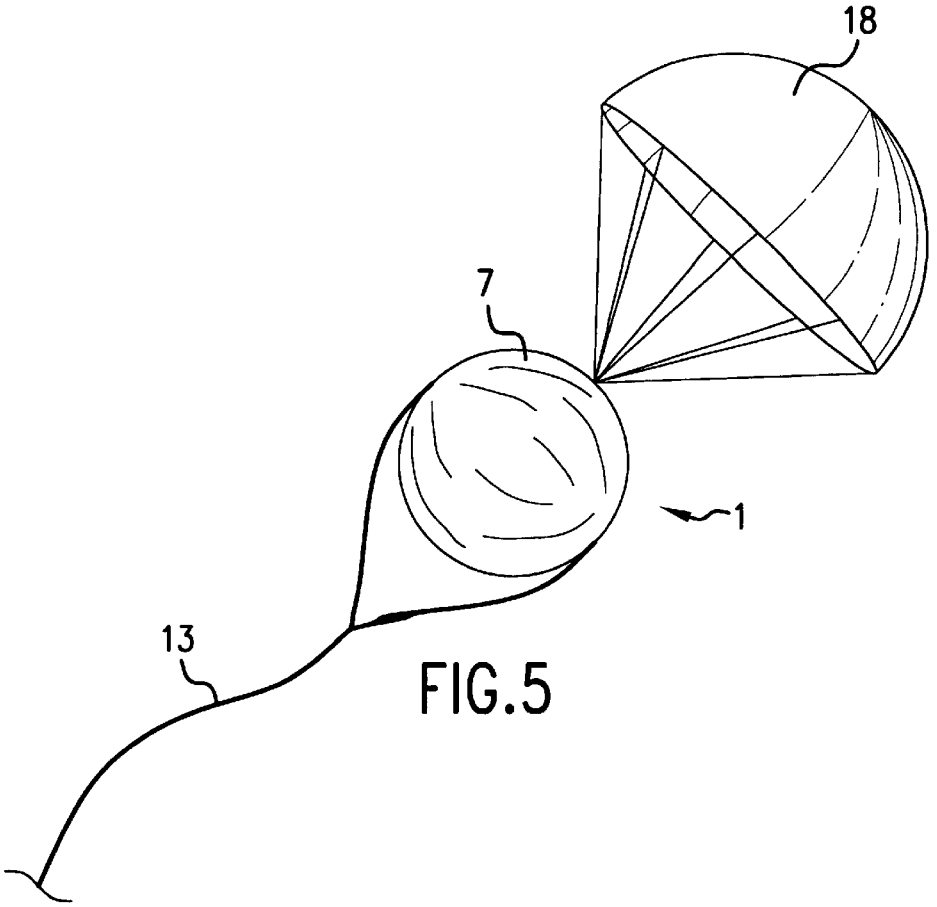
FIG. 5 shows an expanded locating device being lifted upwards by a piece of cloth opened like a parachute.

FIG. 5 shows an expanded locating device 1, wherein the connecting element 13 is again attached to the locating device 1 in the region of the two ends of the torsion spring(s) 2 or 10, 10', respectively (see. FIG. 1 or 2). In addition, a piece of cloth 18 is attached to the envelope 7 of said locating device 1, which piece of cloth will open like a parachute to cause buoyancy of said locating device 1.

Various further changes and modifications are possible. For instance, the releasable locking means 5 may also be a hook pivoted on a bow, e.g. 3', and overlapping the other bow 3, e.g. under spring tension, in the resting position (see FIG. 2). To detach the locking means 5, which may e.g. be such a hook or a latch, a lever with a handle or a push button may be provided acting on said locking means directly or via a rod.

Moreover, the pouch 15 itself may form the releasable locking means; in this embodiment, at least one—larger—velcro region 17 of reasonable strength is provided to keep the locating device 1 together in the state as shown in FIG. 1. The locking means thus formed can then only be opened intentionally by hand, e.g. using a rip cord.

The opening parts 3, 3', 11 may also be of an e.g. more rectangular or polygonal shape. Moreover, in the case of an embodiment having one single torsion spring as shown in FIG. 1, the rigid axis 4 may also be left out, and said torsion spring may also be a torsion bar instead of a coil spring. A U-shaped, folded leaf spring may also be active between said opening parts 3, 3', 11, and the latter may even be integrally connected with such a spring. Particularly plastic or aluminium may be used as material for said opening parts 3, 3', 11, whereas the envelope 7 consists of a sufficiently sturdy woven fabric, cloth or foil.

Figure 6:
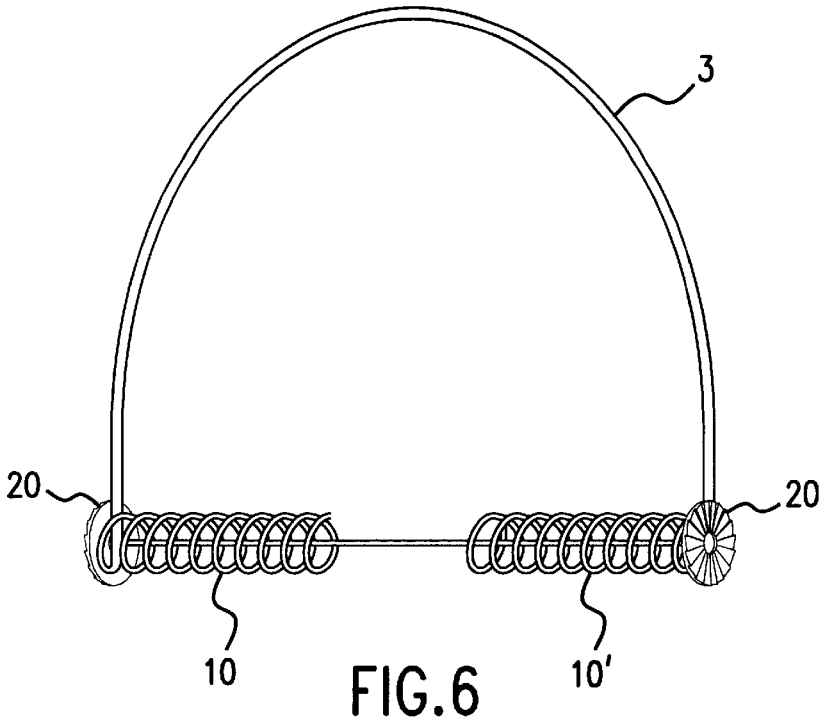
FIG. 6 is a schematic representation of a teeth engaging means located on a bow.

FIG. 6 is a schematic representation of toothed washers 20 to engage the two opening parts 3, 3' located at the two ends of bow 3. Said bow 3 is kept under tension by two torsion springs 10, 10'. The second bow 3' also has one toothed washer 20' (FIG. 8) each at the two ends (not shown in FIG. 6). By the action of said torsion springs 10, 10', two toothed washers are pressed against each other, with their teeth engaging, gliding along each other in the direction of expansion and blocking in the opposite direction.

Figure 7:
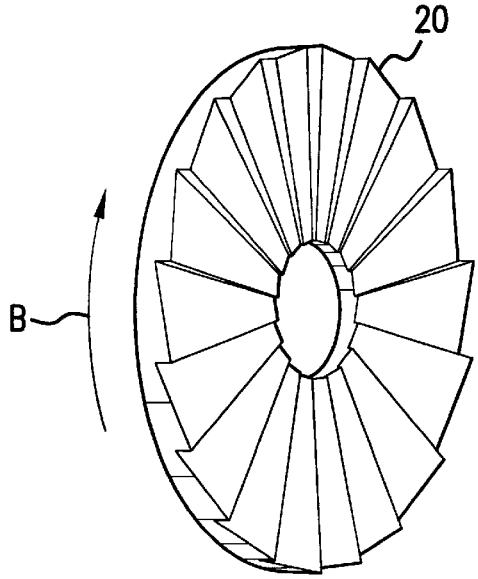
FIG. 7 shows a teeth engaging means on a larger scale.

FIG. 7 is an enlarged representation of a toothed washer 20 rotated during expansion by the spring power of the torsion springs 10, 10' in the direction of arrow B.

Figure 8:
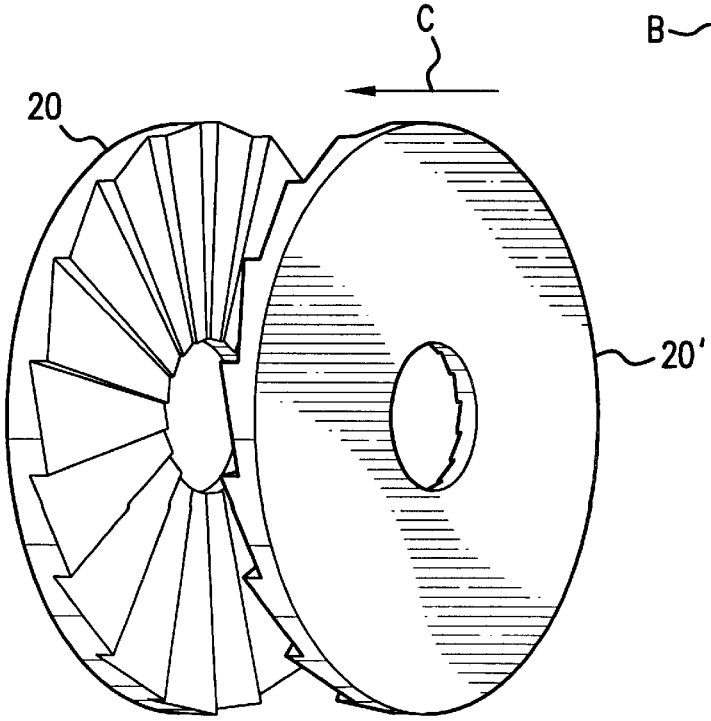
FIG. 8 is a schematic representation of the teeth engaging means according to FIG. 7 with the opposite teeth engaging means.

FIG. 8 is a schematic representation of two toothed washers 20, 20' facing each other; it shows that the teeth engage when said toothed washers 20, 20' are being pressed against each other in the direction of arrow C by the spring power of the torsion springs 10, 10'. Thus the bows are kept in their positions relative to each other so that the locating device 1 remains only partly expanded. Said locating device 1 may only be re-folded by pulling the bows apart in the opposite direction of arrow C and then turning them in the opposite direction of arrow B.

Figure 9:
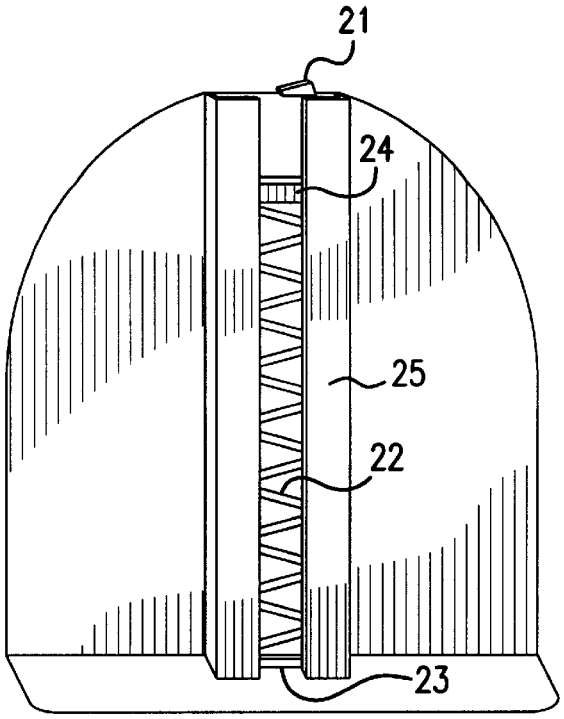
FIG. 9 shows an ejector means using spring power.

FIG. 9 shows an ejector means 21, wherein a spring 22 presses on the one side against a fixed holding means 23 and on the other side against the locating device 1 (not shown in FIG. 9) via a connecting piece 24. When triggered, said spring 22 will expand in an instant, propelling the locating device 1 upwards and away from the user. For better control of direction, the spring 22 is located in a guide rail 25.

Figure 10:
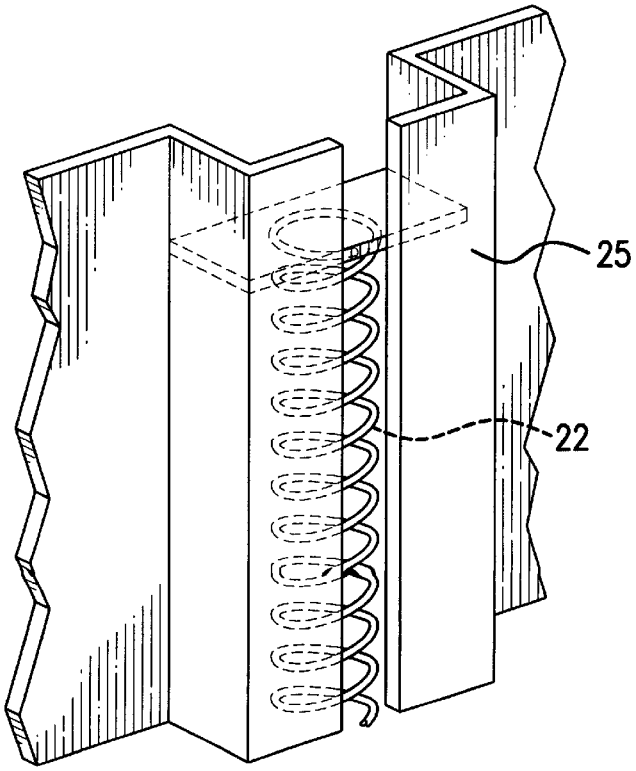
FIG. 10 is an enlarged representation of the spring in the guide rail of the ejector means according to FIG. 9.

FIG. 10 shows said spring 22 in said guide rail 25 on a larger scale. If said spring 22 is activated or triggered, it will expand along said guide rail 25 guiding it during expansion.

What is claimed is:

1. A locating device for avalanche victims, comprising:

an expandable envelope;

at least two essentially rigid opening parts connected to said envelope;

releasable locking means for releasably holding said opening parts in a closed position in which said envelope is in a folded configuration;

drive means coupled to said opening parts for driving said opening parts toward each other upon release of said locking means, to thereby expand said envelope to an expanded configuration; and a connecting element for connecting said locating device to a user.

2. A locating device according to claim 1, further including an ejector for propelling said envelope away from a user prior to expansion, said ejector comprising a guide rail, a tensioned spring located in said guide rail and being connected to said envelope, and a mechanism for releasing said spring from tension upon activation by said user.

3. A locating device according to claim 1, further including a pouch for stowing said envelope in the folded configuration, said pouch comprising at least two pouch parts detachable from each other upon releasing of a pouch seal as said envelope expands.

4. A locating device according to claim 1, wherein said opening parts are formed as bows which are rotatably pivotable about an axis.

5. A locating device according to claim 4, wherein said drive means comprises at least one torsion spring collocated about said axis for maintaining said opening parts under tension in said closed position.

6. A locating device according to claim 5, wherein said at least one torsion spring comprises two axially aligned torsion springs, each of which acts upon a respective opening part.

7. A locating device according to claim 4, further comprising a second locking means for holding said opening parts together in said expanded configuration upon expansion of said envelope by operation of said drive means.

8. A locating device according to claim 4, further comprising at least one intermediate bow connected to said envelope and being rotatably pivotable about said axis between said at least two opening parts.

9. A locating device according to claim 8, wherein said axis comprises a rigid rod-like device.

10. A locating device according to claim 9, wherein said opening parts and said intermediate bow are each mounted on said rigid rod-like device.

11. A locating device according to claim 9 wherein said intermediate bow is mounted on an intermediate segment which in turn is mounted on said rigid rod-like device.

12. A locating device according to claim 8, wherein said intermediate bow is not directly attached to said envelope.

13. A locating device according to claim 1, wherein said opening parts are made of a material selected from the group consisting of aluminum, nylon, polyethylene, and glass fiber plastic.

14. A locating device according to claim 1, further including a plurality of loops for connecting said opening parts to said envelope.

15. A locating device according to claim 1, further comprising a net for covering at least one of said opening parts.

16. A locating device according to claim 1, further comprising a pull cord for releasing said releasable locking means.

17. A locating device according to claim 1, wherein said connecting element is branched into at least two branch connecters, each being separately connected to said locating device.

18. A locating device according to claim 17, wherein s aid connecting element further includes an elastic section.

19. A locating device according to claim 1, further comprising a buoyancy mechanism attached to said envelope for imparting parachute-like buoyancy to said locating device upon operation of said drive means.

20. A locating device according to claim 1, further including a pouch having at least two pouch parts detachable from each other upon release of said locking means, wherein said envelope and opening parts are stored in said pouch in said closed position.

21. A locating device according to claim 1, wherein said opening parts each include engaging means for engaging the other opening part.

22. A locating device according to claim 21, wherein said engaging means includes a toothed washer, said toothed washers being arranged such that they are rotatable against each other in an envelope expanding direction, and block each other in a direction opposite to the envelope expanding direction.

* * * * *